US005971267A

United States Patent [19]

Beckmann

[11] Patent Number: 5,971,267

[45] Date of Patent: Oct. 26, 1999

[54] MAILBOX STAND

[75] Inventor: Robert C. Beckmann, Vale, N.C.

[73] Assignee: R.W.L. Corporation, Hickory, N.C.

[21] Appl. No.: 09/181,237

[22] Filed: Oct. 28, 1998

[51] Int. Cl.[6] ..... B65D 91/00

[52] U.S. Cl. ..... 232/39; 248/218.4

[58] Field of Search ..... 232/39, 17, 45; 248/235, 219.3, 218.4; 108/147.13; D99/32

[56] References Cited

U.S. PATENT DOCUMENTS

| | | | |
|---|---|---|---|
| 3,465,994 | 9/1969 | Block | 232/39 |
| 4,172,579 | 10/1979 | Steinman | 232/39 X |
| 4,213,560 | 7/1980 | Hall | 232/39 |
| 4,300,739 | 11/1981 | Sande | 248/219.4 |
| 4,403,730 | 9/1983 | Batson | 232/39 |
| 4,735,152 | 4/1988 | Bricker | 248/218.4 X |
| 5,020,720 | 6/1991 | Harpe | 232/39 |
| 5,022,618 | 6/1991 | Barrett et al. | 232/39 X |
| 5,386,938 | 2/1995 | West | 232/39 |
| 5,437,409 | 8/1995 | Coushaine | 232/39 |
| 5,620,136 | 4/1997 | Erwin et al. | 232/39 |
| 5,626,317 | 5/1997 | Altman | 248/218.4 X |
| 5,664,729 | 9/1997 | Ladewig | 232/39 |
| 5,779,202 | 7/1998 | Black et al. | 232/39 X |

*Primary Examiner*—Terry Lee Melius
*Assistant Examiner*—William L. Miller
*Attorney, Agent, or Firm*—Hardway/Mann IP Group, Nexsen Pruet Jacobs & Pollard, LLP

[57] ABSTRACT

A mailbox stand comprising a post having a top end and a bottom end, the bottom end capable of ground insertion; a shelf slidably mounted onto the post, the shelf comprising a proximal end, two exterior sides, a bottom side, a top side, a cover and an aperture extending therethrough, the aperture complementary to a shape of the post for engaging the post; and a support structure coupled to the bottom side of the shelf and in communication with the grooved exterior of the post.

14 Claims, 4 Drawing Sheets

MAILBOX STAND

BACKGROUND OF THE INVENTION

1. Field of the Invention

This invention is in the field of vertical posts. More specifically, this invention is used to support a mailbox.

2. Description of Related Art

Mail boxes utilize vertical stands having a bottom end in the ground and secured thereto by sand, stones or concrete. Mounted to the vertical stand is a horizontally extending shelf upon which the standard rural mailbox is mounted. The vertical stand takes a variety of configurations; however, most of the configurations include both a vertical stand and a horizontally extending shelf.

The mailbox stand is mounted adjacent the road and is often subjected to whether, vehicle impacts and vandalism. Replacement is time consuming and a bother since, in many cases, the stand is mounted to the ground.

Disclosed herein is a mailbox stand which is configured so as to provide a sturdy and durable structure, as well as aesthetically pleasing appearance. The mailbox is also easy to assemble and install.

SUMMARY OF THE INVENTION

The present invention provides a mailbox stand comprising a vertically extending post having a grooved exterior, a top end and a bottom end in contact with the ground. The mailbox stand also comprises a horizontally extending shelf slidably mounted onto the vertically extending post. The horizontally extending shelf further comprises a proximal end, two exterior sides, a cover, a bottom side and a top side which defines an aperture near the proximal end which extends through the bottom side for engaging the vertically extending post. On top of the vertically extending post is a post cap removably coupled to the top end. Below the horizontally extending shelf is a support structure which is coupled to the shelf and in communication with the grooved exterior of the vertically extending post.

It is an object of the present invention to provide a mailbox stand.

It is also an object of the present invention to provide a mailbox stand which is structurally sound and easily assembled.

It is a further object of the present invention to provide a mailbox stand which is aesthetically pleasing as well as structurally sound.

The above is a description of a particular embodiment of the present invention. It will nevertheless be understood that no limitation of the scope of the invention is hereby intended, such alterations and further modification in the illustrated device, and such further applications of the principles of the invention as illustrated therein being contemplated as would normally occur to one skilled in the art to which the invention relates. Additional objects and advantages of the invention will become apparent to those skilled in the art upon examination of the following description of the preferred embodiment.

DETAILED DESCRIPTION OF THE INVENTION

Figure 1:
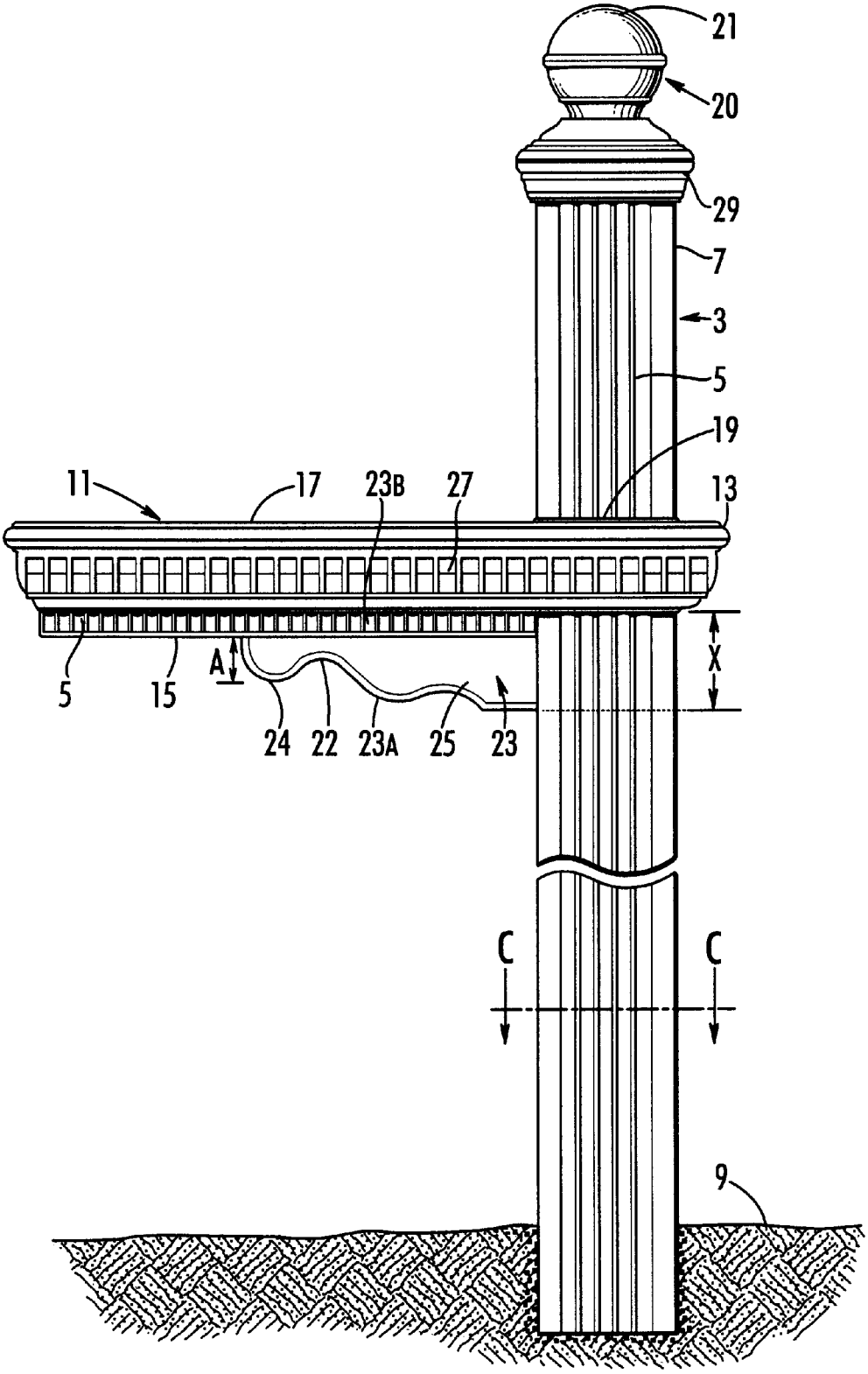
FIG. 1 is a side elevational view of the mailbox stand according to this invention.

Referring now more particularly to FIG.1, there is shown a mailbox stand 1 including a vertically extending post 3 and a horizontally extending shelf 11 slidably mounted onto the vertically extending post 3 and secured to the post 3 by mounting brackets (not shown). The horizontally extending shelf 11 defines an aperture 19 near the proximal end 13 of the shelf 11 by which the shelf 11 is mounted. The top end 7 of the vertically extending post 3 can receive a removable post cap 20. Post cap 20 can have any desired ornamentation, including a rounded extension 21 and/or a return ring 29. The bottom end of the post 3 is in communication with the ground 9.

Figure 2:
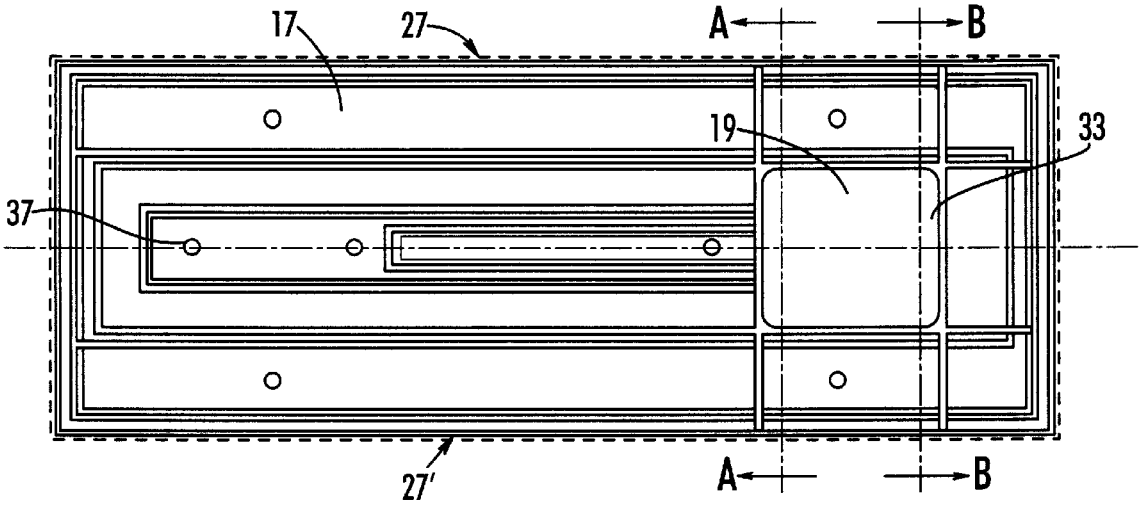
FIG. 2 is a top plan view of the shelf portion of the mailbox stand as seen in FIG. 1.
Figure 5:
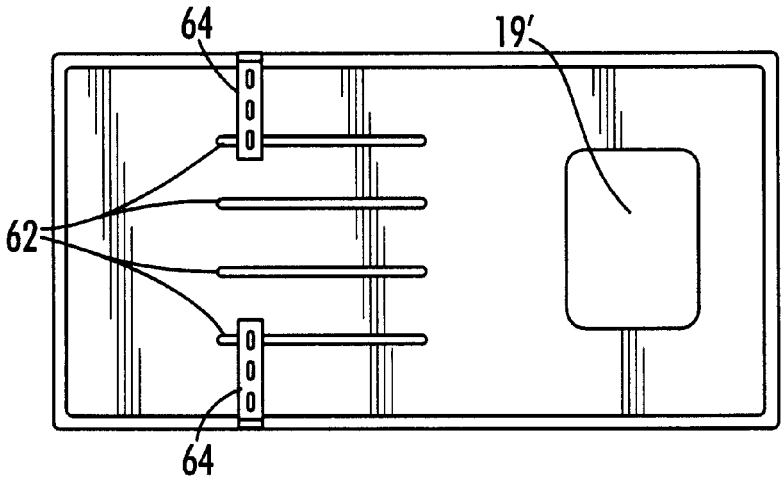
FIG. 5 is a top elevational view of the cover with mounting brackets.

As seen in FIG. 2, the top side 17 of the horizontally extending shelf 11 comprises a set of holes 37 for mounting cover 60, further described in FIG. 5, onto shelf 11. The cover 60 is mounted with fasteners extending through holes in the cover 60 (not shown) which are complimentary to holes 37.

Attached to the bottom side 15 of the horizontally extending shelf 11, as seen in FIG. 1, is a support structure 23 which comprises decorative molding 25. Support structure 23 contacts grooved exterior 5 of the vertically extending post 3 for rigidity. In a preferred embodiment, there are two parallel support structures 23, one at each exterior side 27 and 27' of the shelf 11, which are preferably molded onto shelf 11.

As further seen in FIG. 1, the support structure 23 comprises a lower structure 23*a* which is a series of concave 22 and convex 24 impressions. The lower structure 23*a* has a height (X) along grooved exterior 5 of the vertically extending post 3. The structure 23*a* tapers to a height (A), which is less than height (X), at an opposite end adjacent the connection to the bottom side 15 of the horizontally extending shelf 11. The support structure also comprises an upper structure 23*b* of decorative molding 25 which extends approximately the length of the horizontally extending shelf 11. The support structure 23 is designed to provide support for the weight of the horizontally extending shelf 11 and the mailbox atop the shelf 11.

Figure 3:
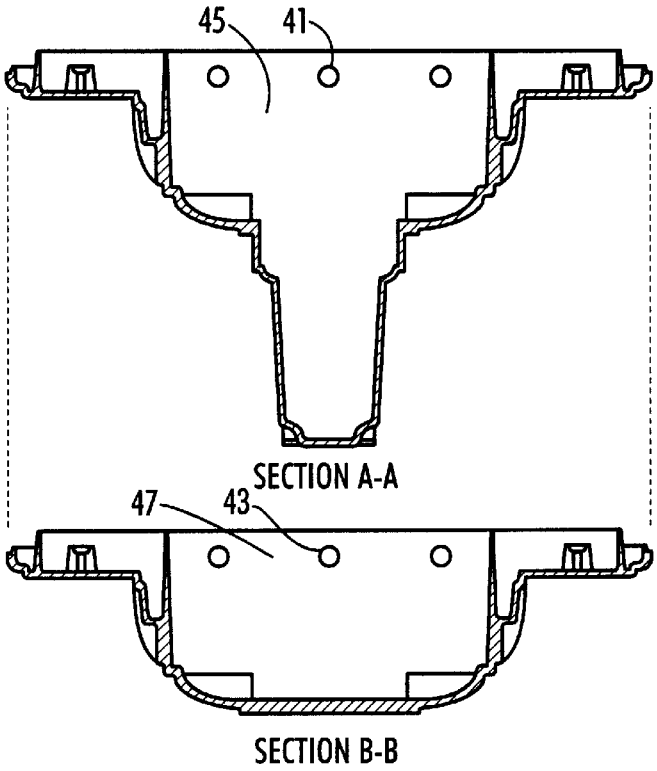
FIG. 3 is a cross-sectional view of aperture along lines B—B and C—C as seen in FIG. 2.
Figure 4A:
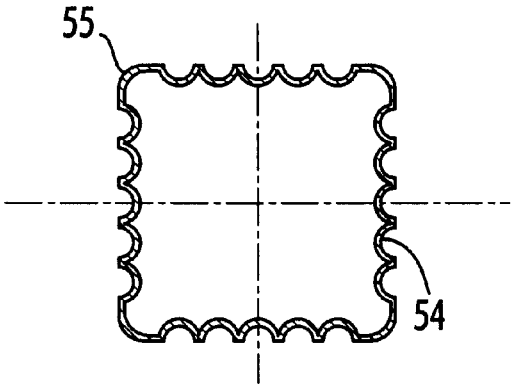
FIG. 4*a* is a cross-sectional view of the post of FIG. 1 along line C—C.
Figure 4B:
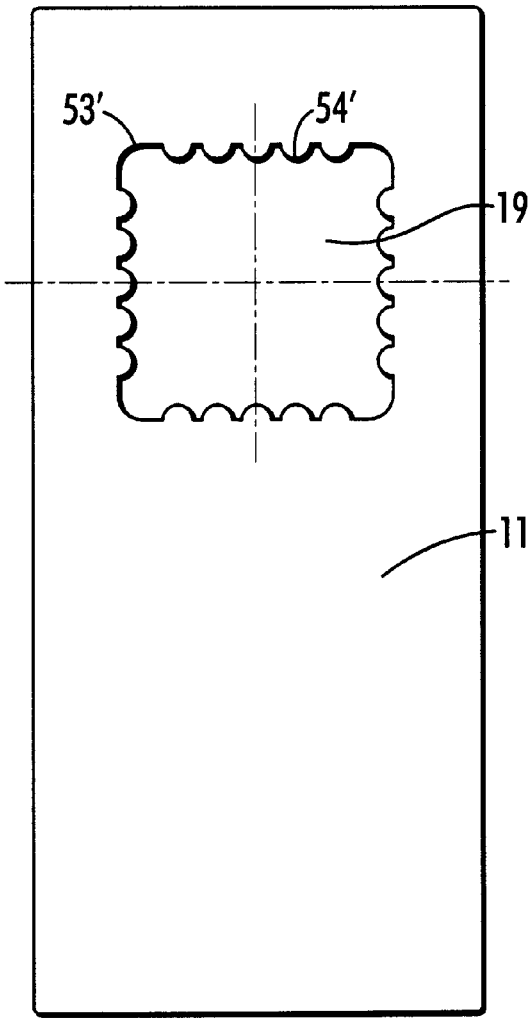
FIG. 4*b* is a preferred embodiment of the aperture having a shape complimentary to the post.
Figure 4:
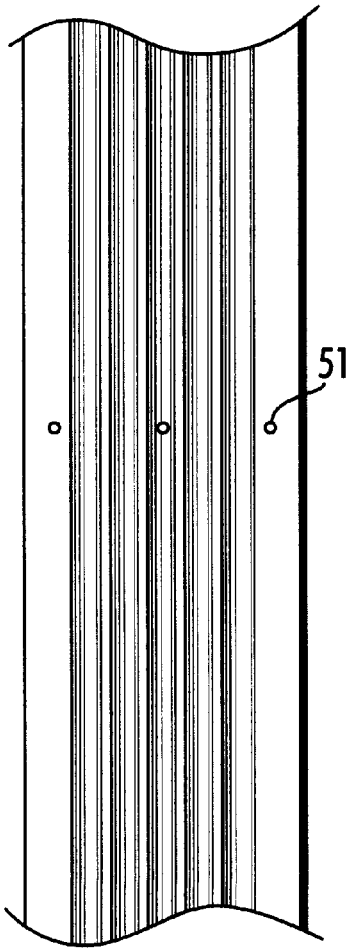
FIG. 4 is a side elevational view of the post as seen in FIG. 1.

As seen in FIG. 3, a cross-sectional view of the horizontally extending shelf 11 at the aperture 19 along line B—B and line C—C shows a set 41 and a set 43 of holes at the front wall 45 and back wall 47 of the aperture 19, respectively. These sets of holes 41 and 43 align with a set of holes 51 on the vertically extending post 3 as seen in FIG. 4 at the point where the horizontally extending shelf 11 is to be mounted onto the vertically extending post 3. The mounting is accomplished by a fastening means, preferably bolts or screws, which pass through the sets of holes at the front wall 45, the back wall 47 and the post 3.

In order to provide additional rigidity to and to simplify assembly of the mailbox stand 1, aperture 19 is complementary to the shape of the vertically extending post 3. In a preferred embodiment as seen in FIG. 4*a*, a cross-sectional view along line C—C (FIG. 1) of the vertical post 3 shows the rounded corners 53 and scalloped faces 54 formed by the grooved exterior 5 of the vertically extending post 3. As seen in FIG. 4*b*, aperture 19 likewise comprises rounded corners 53' and scalloped faces 54' formed to complement the design of the vertically extending post, allowing for a smooth sliding fit of the shelf 11 onto the post 3. The aperture 19 should be slightly larger than the post to allow such a fit. Post 3 may come in any desirable pattern or shape. In any instance, the aperture 19 should be in a pattern or shape which is complementary to the shape of the post 3.

Figure 5A:
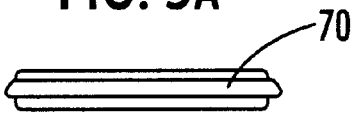
FIG. 5*a* is a front elevational view of the cover.
Figure 5B:
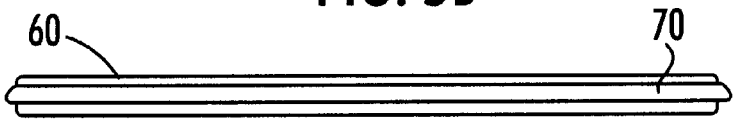
FIG. 5*b* is a side elevational view of the cover.

As seen in FIG. 5, cover 60 is provided for accommodating a conventional mailbox of various sizes, the cover 60 also having an aperture 19' which is complimentary in shape and dimension to aperture 19. The cover 60 further comprises a number of slots 62 running in a direction perpendicular to aperture 19, the slots comprising holes for receiving a fastener. As seen in FIGS. 5*a*–5*b*, the cover 60 also comprises decorative features 70 consistent with shelf 11.

Figure 6:
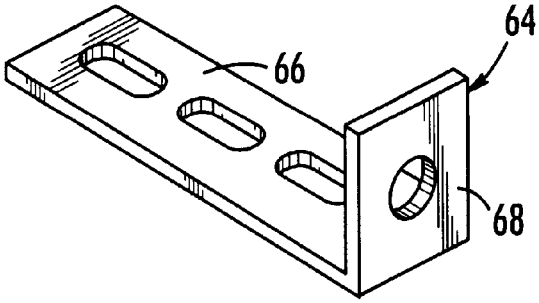
FIG. 6 is a perspective view of the mounting brackets for mounting the mailbox onto the shelf.

Mounting brackets 64, shown in FIGS. 5 and 6, are utilized to secure a mailbox to the cover 60. The mounting bracket 64 is preferably an "L" bracket comprising 3 openings on a bottom side 66 and one opening on an extended side 64. The bracket is attached by a fastener at a position on any one of slots 62 of cover 60 to accommodate the dimensions of the mailbox to be mounted. A fastener is also used to secure the mailbox between the brackets 64, the fastener preferably extending through hole 68 and into communication with a side of the mailbox.

Thus, a mailbox post which is durable, sturdy and easy to assembly, as well as aesthetically pleasing has been disclosed. As the above description is merely exemplary in nature, being merely illustrative of the invention, many variations will become apparent to those of skill in the art. Such variations, however, are included within the spirit and scope of this invention as defined by the following appended claims.

That which is claimed:

1. A mailbox stand comprising:

a post having a top end and a bottom end, said bottom end capable of ground insertion;

a shelf slidably mounted onto said post, said shelf comprising a proximal end, two exterior sides, a bottom side, and a top side;

a cover for said shelf substantially coextensive with and directly attached to said top side, said cover and said shelf defining aligned apertures, said apertures complementary to a shape of said post for engaging said post; and a support structure coupled to the bottom side of said shelf and in communication with said post.

2. The mailbox stand according to claim 1 wherein said shelf aperture further comprises a front wall and a back wall; and wherein said shelf defines a first set of holes and second set of holes at said front wall and said back wall of said shelf aperture, respectively.

3. The mailbox stand according to claim 2 wherein said post defines a third set of holes adjacent said top end of said post, such that when said shelf is mounted onto said post, said third set of holes are aligned with said first set of holes and said second set of holes.

4. The mailbox stand according to claim 3 wherein said shelf is secured to said post by a first fastener passing through said first set of holes, said second set of holes and said third set of holes.

5. The mailbox stand according to claim 1 wherein said apertures are slightly wider than said post.

6. The mailbox stand according to claim 1 further comprising a post cap removably coupled to said post.

7. The mailbox stand according to claim 6 wherein said post cap comprises a return ring.

8. The mailbox stand according to claim 1, wherein said cover comprises slits, and wherein said cover is capable of securing a mailbox to said shelf at said slits by fasteners.

9. The mailbox stand according to claim 1 wherein said bottom side of said shelf comprises a fourth set of holes; and wherein said support structure is secured to said bottom side of said shelf by a fastener engaging said fourth set of holes.

10. The mailbox stand according to claim 9 wherein said support structure comprises decorative molding.

11. The mailbox stand according to claim 9, wherein said support structure comprises two structures placed in parallel near said exterior sides of said shelf, said shelf being horizontally extending.

12. The mailbox stand according to claim 1 wherein said post has a vertically grooved exterior and wherein said shape of said post comprises rounded corners and scalloped faces.

13. The mailbox stand according to claim 12 wherein said shelf aperture comprises rounded corners and scalloped faces, complementing said shape of said post.

14. A mailbox stand comprising:

a post having a vertically grooved exterior, a top end and a bottom end, said bottom end capable of ground insertion and said top end further comprising a tapered portion having a horizontally grooved exterior;

a shelf slidably mounted onto said post, said shelf comprising a top side and exterior edges decoratively notched to form a continuous grooved pattern along a length of said shelf;

a cover for said shelf substantially coextensive with and directly attached to said top side, said cover and said shelf defining aligned apertures, said apertures complementary to a shape of said post for engaging said post;

a cap secured to said top end of said post, said cap having a rounded exterior comprising a horizontally grooved exterior; and a support structure comprising a decorative strip and a base, said decorative strip with a length less than the length of said shelf, said strip comprising a series of notches extending the length of the decorative strip; and said base in communication with said strip and said grooved exterior of said post, said base having a series of concave and convex impressions, the length of said base being less than the length of said strip.

* * * * *